United States Patent [19]

Maurice

[11] 3,947,193

[45] Mar. 30, 1976

[54] MOLECULAR VACUUM PUMP STRUCTURE

[75] Inventor: Louis Maurice, Paris, France

[73] Assignee: Compagnie Industrielle des Telecommunications Cit-Alcatel, France

[22] Filed: Mar. 28, 1974

[21] Appl. No.: 455,657

[30] Foreign Application Priority Data

Mar. 30, 1973 France ..... 73.11549

[52] U.S. Cl. ..... 415/143; 417/201; 415/90

[51] Int. Cl.[2] ..... F04D 1/10

[58] Field of Search ..... 415/90, 198, 62, 143; 417/199 R, 201

[56] References Cited

UNITED STATES PATENTS

| | | | |
|---|---|---|---|
| 1,906,715 | 5/1933 | Penick | 415/90 |
| 2,479,724 | 8/1949 | Bucklein | 415/90 |
| 2,730,297 | 1/1956 | Van Dorsten et al. | 415/90 |
| 3,168,977 | 2/1965 | Garnier et al. | 415/90 |
| 3,404,867 | 10/1968 | Williams et al. | 415/90 |
| 3,749,528 | 7/1973 | Rousseau | 415/90 |
| 3,832,084 | 8/1974 | Maurice | 415/90 |

FOREIGN PATENTS OR APPLICATIONS

| | | | |
|---|---|---|---|
| 48,217 | 11/1939 | Netherlands | 415/90 |

*Primary Examiner*—Henry F. Raduazo
*Attorney, Agent, or Firm*—Craig & Antonelli

[57] ABSTRACT

The structure comprises a turbo-molecular pumping element providing a very moderate compression ratio and a rotating drum type pumping element equipped with an interchangeable stator or drum. These two elements are mounted in series and driven in a rotating movement by a single shaft. On the interchangeable part, parallel helical grooves whose depth depends on the molecular mass of the gas to be pumped are formed.

9 Claims, 2 Drawing Figures

MOLECULAR VACUUM PUMP STRUCTURE

BACKGROUND OF INVENTION

Turbo-molecular pumps which are similar in structure to turbines but which resemble the Gaëde molecular pump in their operating principle, that is, that their compression energy finds its source in the shock of the molecules against the walls in motion, have been known for a long time.

It is also known that this type of pump is, at present, the object of great development in the field of vacuum techniques, in which these pumps are used as secondary pumps because of their aptitude to constitute an effective barrier against oil vapors which may be retrodiffused from the primary vacuum.

It is also known that the compression ratio per stage of a molecular pump may be evaluated by means of a mathematical formula expressing the fact that the logarithm of the compression ratio per stage is proportional to the square root of the molecular mass of the pumped gas. The result of this is that these pumps have remarkable effectiveness for the removal of heavy gases, such as, more particularly, oil vapors, but that, on the other hand, their performance is very slight in contact with a light gas, such as hydrogen which, it is known, is always found in great proportions in the residual atmosphere of enclosures in which a vacuum is formed.

In this way, for example, a turbo-molecular pump having 16 stages with a compression ratio of $10^8$ for nitrogen would cause a perfectly, satisfactory removal of the heavy vapors such as oil vapors, but it can be easily calculated that the compression ratio of hydrogen would only be in the vicinity of $10^2$, this being clearly insufficient in a great number of cases.

It is very easy to observe that, to reach the same compression ratio as for nitrogen, it would be necessary to have available 3.7 times as many stages. That is, a pump would require 59 or 60 stages, and this is prohibitive.

Even if certain users can accept the use of such equipment, its price would be all the higher for those users who only need to remove nitrogen in which a turbo-molecular pump having 16 stages is preferred. In this way, the constructor would be induced to produce very small series of pumps having a varied number of stages corresponding to the requirements of each to be used; and in conclusion, turbo-molecular pumps are not very easy to adapt to the kind of gas to be pumped and their manufacturing cost remains high.

But it is known on the other hand that these turbo-molecular pumps have the great advantage of a very substantially constant output whatever the molecular mass of the gases pumped may be.

It, therefore, appears to be an advantage to combine these properties of turbo-molecular pumps capable of pumping gases having different molecular masses with the same output, but at a different compression ratio, with the properties of rotating drum type molecular pumps in which the manufacturer can increase at will the compression ratio simply by modifying the depth of the grooves.

Indeed, it is known that rotating drum type molecular pumps comprise a cylindrical drum rotating at high speed with slight clearance inside a stator whose inside face is also cylindrical. On the inside face of the stator, on the outside face of the drum, or on both the two adjacent faces, several parallel grooves are formed having a helical shape whose depth, decreasing from the inlet to the output, determines the compression ratio for a given gas, and whose cross-section determines the output.

It is known that this output is, as a general rule, less than the required output. However, on connecting up the suction part of such a rotating drum type molecular pump to the outlet of a turbo-molecular pump, whose output is satisfactory, the output in weight of the rotating drum type molecular pump is improved since the latter will have an effect on a gas whose volume has been reduced in a proportion equal to the compression ratio of the turbo-molecular pump. The advantage thus obtained is very clear, but it may nevertheless be considered insufficient or too expensive by users if the two pumps are not perfectly adapted to each other and do not meet certain requirements. Thus, on examining again the preceding example, and if the molecular pump having 16 stages providing a compression ratio of $10^8$ for nitrogen and about 100 for hydrogen is combined with a drum type molecular pump whose depth has been especially calculated for hydrogen, it will be possible to produce a total compression ratio, for hydrogen, of $10^3$, but the price of such an equipment will remain prohibitive since the price of the complete turbo-molecular pump is added to that of the rotating drum type pump.

It may be conceived that if a structure affording an advantage, combining these two types of pumps is required to be produced, it is necessary to adapt the two types of pumps to each other by harmoniously distributing the compression ratio to be established between the two components, so as to improve the discharge in weight of the part of the structure fulfilling the function of a rotating drum type molecular pump.

In order to reduce the size and cost of a structure combining a turbo-molecular pumping element with a rotating drum type pumping element, it is considered in the present invention an advantage to contrive a standard element in which the number of stages of the turbo-molecular element has as low a value as possible, making it possible, nevertheless, to obtain a substantial improvement in the output in weight of the rotating drum type molecular pumping element.

SUMMARY OF INVENTION

In this way, from a general point of view, the object of the invention is a molecular vacuum pump structure comprising a turbo-molecular pumping element and a rotating drum type pumping element mounted on the same pivot or shaft, the outlet of the turbo-molecular pumping element being connected in a very direct way to the inlet of the rotating drum type pumping element, characterized in that the turbo-molecular element comprises a small number of stages providing, for a given gas, a compression ratio in the same order as the ratio of the output in volume of the two pumping elements.

Thus, for example, when the gas chosen is nitrogen and the ratio of the output of the two pumping elements is in the order of 100, the compression ratio of the turbo-molecular pumping element, a structure having a rotor diameter of 200 mm, which has, for a conventional rotation speed of 24,000 rpm, a compression ratio, per stage, for nitrogen, of 3.3, this being substantially in the order of $\sqrt{10}$, it will be observed that a turbo-molecular pumping element having four stages will give a satisfactory compression ratio of $(\sqrt{10})^4 = 100$ It has been specified above that the compression ratio obtained at the outlet of the turbo-molecular element will be different if the molecular mass of the gas pumped is different.

The result of this is that in numerous cases it is an advantage to adapt the cross-section and the depth of the grooves of the drum type molecular pumping element, which comes after the turbo-molecular pumping element to the type of gas for which the pumping unit is called upon to handle the most frequently, or to the gas whose removal is considered indispensable by the user. Moreover, taking into account the fact that in industry, each pumping assembly is assigned during a long period to a single function, the present invention provides a structure suitable for satisfying all the requirements of the users in industry, and comprising an easily interchangeable part, which may be adapted to each particular problem.

A structure which also forms the object of the invention comprises, consequently, a turbo-molecular pumping element in which the number of stages is very small and a cylindrical drum type turbo-molecular pumping element rotating in a cylindrical stator, in which multiple grooves are formed only on one of the two adjacent cylindrical parts are driven at high speed by the same shaft, characterized in that the part on which the threads are formed is made easy to remove.

Thus, the present invention provides a structure meeting all the requirements of industry after slight adaptation. The whole advantage of such a structure in which it is possible to mass-produce in great quantities and for which it is possible to reduce very greatly the manufacturing price in relation to the manufacturing price of a structure manufactured especially to meet such a particular industrial requirement will be appreciated.

In the case where the grooves have a certain depth, it appeared advantageous to form them on the stator of the rotating drum type molecular pumping element, thus leaving the drum perfectly smooth. It was necessary to design a structure of the "suspended" type to make dismantling of the stator of the rotating drum type molecular pumping element easy. To simplify assembling, it is first an advantage to make the two rotors fixed together and to connect them to the shaft. The stator of the turbo-molecular pumping element then supports the stator of the rotating drum type molecular pumping element which is itself connected to a housing covering the base part which supports the rotating shaft. The dismantling of the stator is then obtained by detaching the stator of the rotating drum type pumping element from the stator of the turbo-molecular pumping element after having removed the housing in a downwards direction.

It may happen that the user needs, on the contrary, a pump which pumps all usual gases very well but which nevertheless also draws off a great quantity of hydrogen. In this case, the present invention combines a drum type molecular element having multiple grooves of a very recent type with the turbo-molecular element in which each groove is subdivided over a part of its length into an increasing number of narrower channels from the inlet to the outlet.

Such a rotating drum type molecular pumping element makes it possible to improve the compression ratio in a spectacular way while maintaining a high discharge. A full use is found for such an element in the combining thereof with the turbo-molecular element having a moderate compression ratio.

The invention will be better understood from an example of an embodiment, having no limiting character in which the grooves of the rotating drum type element are formed on the stator, as described below by reference to the drawing figures representing a very diagrammatic cutaway view of such a structure having an interchangeable stator element, and in which FIG. 1 is a cutaway view of a vacuum pump according to the present invention, and FIG. 2 is a plane view of a surface wall of the rotating drum portion of the pump of FIG. 1, including subdivided grooves.

DESCRIPTION OF THE PREFERRED EMBODIMENT

Figure 1:
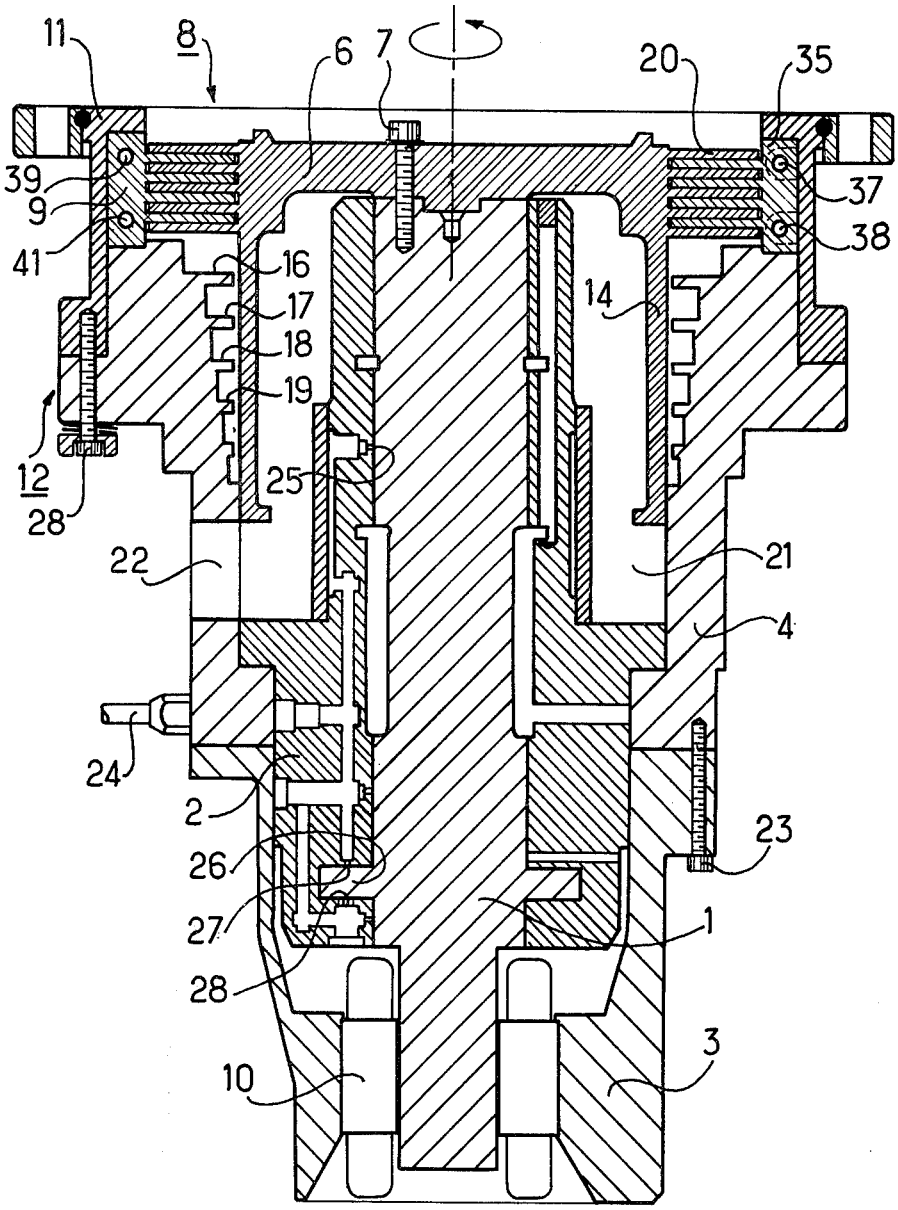

On referring to FIG. 1 showing diagrammatically a model of an embodiment of the structure according to the invention, it will be seen that there is a shaft or pivot 1 driven in a rapid rotating movement by a motor 10. A pivot support 2 provided with internal ducts surrounds and supports the pivot 1. A housing 3 protects the pivot support 2. It is connected to the detachable stator element 4 by screws such as 23 which may easily be removed.

Pumping is obtained by drawing the gases away towards a turbo-molecular pumping element 8 comprising a rotor 6 made fast with the pivot 1 by a removable screw 7 rotating in a stator 9 fixed by the connection flange 11. That turbo-molecular element 8 comprises a certain number of stages 20 bearing fins (not shown). The rotating drum type element 12 consists of a smooth cylindrical rotor 14 extending from the rotor element 6 with which it is integrally connected and of a removable stator 4 surrounding the cylindrical rotor 14. On the internal wall of the stator element 4, facing the cylindrical rotor 14, multiple helical grooves such as 16, 17, 18, 19, etc., having a decreasing depth from the inlet to the outlet, are formed. In the example of the embodiment, the stator comprises six parallel helical grooves having decreasing depth.

A turbo-molecular element having four stages, to provide, at zero output, a compression ratio for nitrogen in the order of 100, is used to great advantage. That element, which has four times fewer stages than that of the turbo-molecular pump considered above, by way of an example, would provide, if it were taken separately, only an insufficient vacuum. But a compression ratio of the order of 100 for nitrogen makes it possible to feed the drum type molecular pumping element situated downstream from the turbo-molecular element in conditions which prove to be a great advantage. Indeed, if the output in volume of a drum type molecular element is defined by the cross-section of the grooves formed, for example, on the stator, the output in weight will be all the higher as the density of the gas which flows is high. The result of this is that the presence of a turbo-molecular element arranged between the secondary vacuum and the rotating drum type molecular element actually has the effect set forth above, i.e. it improves, in very great proportions, the output in weight of the rotating drum type molecular element.

The rotating drum type pumping element 12 receives the gaseous flux discharged by the turbo-molecular element 8, where the gaseous flux is still compressed. A toroidal chamber 21 enables the collecting of the gaseous flux discharged by the rotating drum type pumping element 12. That gaseous flux, discharged by the passage 22, is directed towards the primary pump (not shown).

The pivot rotates without friction on the fluid bearings. Indeed, the pivot support 2 comprises, in a known way, a compressed air inlet 24 and a network of ducts leading to fluid bearings such as 25 enabling the rotating pivot to be centered in relation to the fixed structure. The pivot support 2 comprises a recess containing a rotating flange 26 having a rectangular cross-section and carried by and forming part of the pivot 1. It is kept in a stable position by opposing balanced jets of air such as 27, 28 coming from the appropriate ducts of the air inlet 24. The rotating flange 26 thus acts as a gas stop for the pivot 1.

The stator 9 of the turbo-molecular element 8 is constituted by two half rings such as 35 held in place with precision between the stator 4 of the rotating drum type pumping element and the connection flange 11, by the adjustment of removable screws such as 28. The two half rings 35 are, moreover, assembled by means of tangent screws 37, 38, 39 and 41.

A certain number of seals provide fluid-tight sealing between the various parts constituting the pumping structure. They are arranged according to a technique known by one skilled in the art.

For pumping nitrogen, a stator having six parallel grooves whose depth varies between 17.5 mm at the inlet end and 0.75 mm at the outlet end is used. The compression ratio thus obtained at zero output is $10^8$, the discharge of the structure as a whole reaching 350 liters per second.

When a gas having a very different molecular mass, such as hydrogen, for example, is required to be pumped, it is necessary to assemble on the rotating drum type molecular pumping element 12 a different stator.

The screws such as 23 are removed so as to remove the housing 3 downwards. It is then sufficient to unscrew screws such as 28 to remove the stator 4 downwards.

It is then possible to install, for the pumping of hydrogen, a stator 4 having six grooves with a depth equal to 4 mm at the inlet and to 1.5 mm at the outlet towards the primary pump. The compression ratio thus obtained at zero discharge is in the order of $10^5$ and the discharge is in the order of 40 liters per second approximately.

In the case where gases heavier than nitrogen and whose specific gravity is close to that of argon ($A = 40$) are to be pumped, a stator having six grooves with a depth varying between 30 mm at the inlet and 2 mm at the outlet towards the primary pump will be placed on the removable structure. The discharge will be about 400 liters and the compression ratio at zero discharge will be $10^8$.

The structure as a whole, the pivot 1, the pivot support 2, the turbo-molecular pumping element 8, the rotor assembly 6 and the housing 3 remain unchanged whatever the stator 4 installed may be. The result of this is a very great reduction in the manufacturing price of such structures which may be mass-produced in great quantities and equipped, at the user's request, with one stator or another according to the kind of gas to be pumped.

The invention also contemplates structures in which the six parallel grooves are formed on the rotor cylinder with the stator being smooth. The results obtained with grooves having the same depth are comparable in all points to the results obtained with grooves formed on the stator.

To avoid increasing manufacturing costs, the rotor cylinder 14 can be screwed onto the rotor assembly 5 and only the cylindrical part is made interchangeable. This arrangement is preferable for pumps intended more particularly for relatively light gases, where the grooves formed are not very deep. The arrangement with the interchangeable stator has been applied to all cases, whatever the density of the fluid to be pumped may be.

Figure 2:
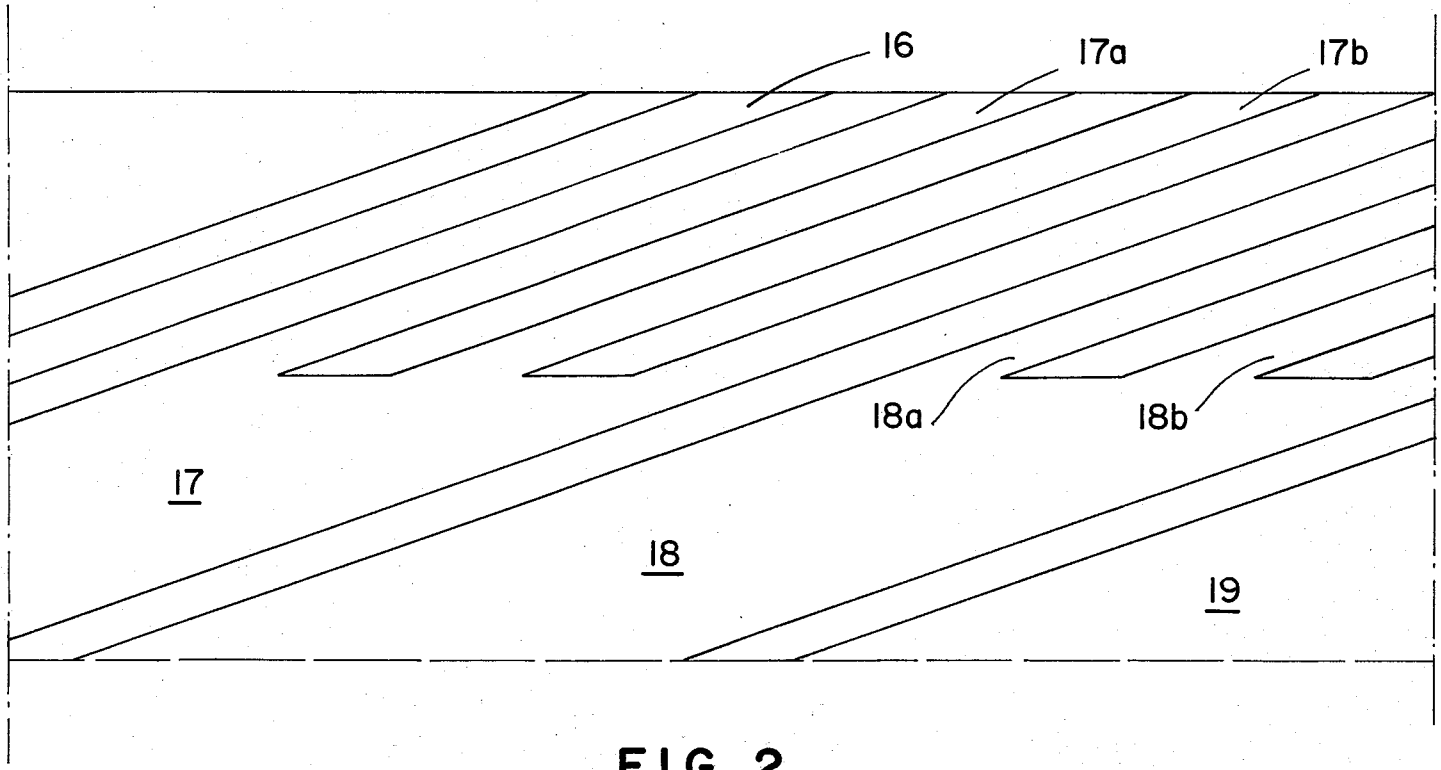

When the user wishes to use a pumping device suitable for pumping all gases without exception, it is further possible to satisfy him in a fairly complete way by using a stator of a recent kind, wherein a multi-groove type in which the number of grooves increases going from the suction towards the discharge by subdivision of each groove comprised between two successive threads by one or several additional threads forming at least two separate channels such as illustrated in FIG. 2. Such measures have only a slight incidence on the cost of machining and enable the compression ratio to be increased without reducing the output by stopping, to a great extent, the leakages.

Thus, by using a stator in which the depth of the grooves varies between 8 mm and 1 mm, a stator element in which each groove is subdivided into 2 channels starting from the third of the length of each thread, from the inlet to the outlet, has been produced. Then, each of the grooves is subdivided again into two channels starting from the second third of the length of each groove. Such a device gives, further, for light gases whose mass is close to that of hydrogen, a compression ratio at zero output in the order of $10^4$ to $10^5$ and a discharge of 30 to 40 liters approximately, but it also enables the obtaining, for a gas such as air having a density close to that of nitrogen, a discharge in the order of 200 liters per second while having at zero output, a compression ratio clearly higher than $10^6$.

Although the devices which have just been described appear to afford the greatest advantages for implementing the invention to satisfy the requirements of users in particular technical conditions, it will be understood that various modifications bearing on the type of the stator grooves, their number and their depth, as well as on the type of the stages of the turbo-molecular element and on their number may be made without going beyond the scope of the invention, it being possible to replace certain of these elements by others capable of fulfilling the same technical function therein.

What I claim is:

1. A molecular vacuum pump arrangement comprising:

turbo-molecular pumping means for providing evacuation of predetermined gases, said turbo-molecular pumping means including a predetermined number of stages, rotating-drum pumping means directly connected to said turbo-molecular pumping means for providing further evacuation of said predetermined gases, wherein said turbo-molecular pumping means includes an outlet corresponding to an inlet of said rotating-drum pumping means, and shaft means for rotatably supporting rotating elements of both of said turbo-molecular pumping means and said rotating-drum pumping means.

2. A molecular vacuum pump arrangement according to claim 1, wherein said shaft means includes a common shaft rotatably supporting a rotor of said turbo-molecular pumping means and a rotor of said rotating-drum pumping means.

3. A molecular vacuum pump arrangement according to claim 2, wherein said rotor of said rotating-drum pumping means has a cylindrical surface, and wherein said rotating-drum pumping means includes a cylindrical stator having an internal face adjacent said cylindrical surface of said rotor, one of said cylindrical surface and said internal face being provided with a plurality of helical grooves.

4. A molecular vacuum pump arrangement according to claim 3, wherein each of said plurality of helical grooves has a decreasing depth in the direction going from said inlet toward an outlet of said rotating-drum pumping means.

5. A molecular vacuum pump arrangement according to claim 3, wherein the part of said rotating-drum pumping means being provided with said grooves is removably attached to said rotating-drum pumping means.

6. A molecular vacuum pump arranged according to claim 1, wherein said predetermined number of stages of said turbo-molecular pumping means are determined for said predetermined gases to provide a compression ratio for said turbo-molecular pumping means of the same order as the ratio of the volume output of said turbo-molecular pumping means and said rotating-drum pumping means.

7. A molecular vacuum pump arrangement comprising:

turbo-molecular pumping means for providing evacuation of predetermined gases, said turbo-molecular pumping means including a predetermined number of stages, rotating-drum pumping means directly connected to said turbo-molecular pumping means for providing further evacuation of said predetermined gases, wherein said turbo-molecular pumping means includes an outlet corresponding to an inlet of said rotating-drum pumping means, and shaft means for rotatably supporting rotating elements of both of said turbo-molecular pumping means and said rotating-drum pumping means, wherein said shaft means includes a common shaft rotatably supporting a rotor of said turbo-molecular pumping means and a rotor of said rotating-drum pumping means, wherein said rotor of said rotating-drum pumping means has a cylindrical surface, and wherein said rotating-drum pumping means includes a cylindrical stator having an internal face adjacent said cylindrical surface of said rotor, one of said cylindrical surface and said internal face being provided with a plurality of helical grooves, wherein the part of said rotating-drum pumping means being provided with said grooves is removably attached to said rotating-drum pumping means, and wherein said shaft means includes a removable support housing to which said part of said rotating-drum pumping means with said plurality of grooves is removably attached, said support housing further supporting said rotatable shaft to which said respective rotors are connected.

8. A molecular vacuum pump arrangement according to claim 7, wherein said rotatable shaft is supported in said support housing by means of fluid bearings.

9. A molecular vacuum pump arrangement comprising:

turbo-molecular pumping means for providing evacuation of predetermined gases, said turbo-molecular pumping means including a predetermined number of stages, rotating-drum pumping means directly connected to said turbo-molecular pumping means for providing further evacuation of said predetermined gases, wherein said turbo-molecular pumping means includes an outlet corresponding to an inlet of said rotating-drum pumping means, and shaft means for rotatably supporting rotating elements of both of said turbo-molecular pumping means and said rotating-drum pumping means, wherein said shaft means includes a common shaft rotatably supporting a rotor of said turbo-molecular pumping means and a rotor of said rotating-drum pumping means, wherein said rotor of said rotating-drum pumping means has a cylindrical surface, and wherein said rotating-drum pumping means includes a cylindrical stator having an internal face adjacent said cylindrical surface of said rotor, one of said cylindrical surface and said internal face being provided with a plurality of helical grooves, and wherein each of said plurality of helical grooves is subdivided in the direction downstream from said inlet toward an outlet of said rotating-drum pumping means.

* * * * *